US006846073B2

(12) United States Patent
Yamamoto et al.

(10) Patent No.: US 6,846,073 B2
(45) Date of Patent: Jan. 25, 2005

(54) INK JET PRINTER AND ITS THICK FILM PRINTING METHOD

(75) Inventors: Yasuo Yamamoto, Ibaraki-ken (JP); Akiko Hayashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 11 days.

(21) Appl. No.: 10/362,540

(22) PCT Filed: Aug. 31, 2001

(86) PCT No.: PCT/JP01/07548

§ 371 (c)(1),
(2), (4) Date: Feb. 24, 2003

(87) PCT Pub. No.: WO02/18144

PCT Pub. Date: Mar. 7, 2002

(65) Prior Publication Data

US 2003/0179270 A1 Sep. 25, 2003

(51) Int. Cl.[7] ..... B41J 2/01
(52) U.S. Cl. ..... 347/102; 400/679
(58) Field of Search ..... 347/102, 101, 347/167; 700/118, 119, 120; 264/401; 400/127, 109, 109.1; 101/18

(56) References Cited

U.S. PATENT DOCUMENTS 5,140,937 A * 8/1992 Yamane et al. ..... 118/695
5,416,312 A * 5/1995 Lamoure ..... 235/494

FOREIGN PATENT DOCUMENTS

| | | | |
|---|---|---|---|
| JP | 6362738 | * | 3/1988 |
| JP | 63-062738 | | 3/1988 |
| JP | 9503969 T | | 4/1997 |
| JP | 2000-037943 | | 2/2000 |
| JP | 2000-158745 | | 6/2000 |
| JP | 2000-190462 | | 7/2000 |

* cited by examiner

*Primary Examiner*—Stephen D. Meier
*Assistant Examiner*—Ly T Tran
(74) *Attorney, Agent, or Firm*—Nath & Associates PLLC; Marvin C. Berkowitz; Derek Richmond

(57) ABSTRACT

An inkjet printer performing printing a print paper (3) by ejecting an UV-curing type ink to the print paper (3) through an inkjet print head (5) includes an ultraviolet irradiation device (A) having an ultraviolet light generation section (10) for generating ultraviolet light and optical fibers (11*a*, 11*b*) through which the ultraviolet light generated by the section (10) is guided to a position close to the inkjet print head (5). In the inkjet printer, ink ejection and ink curing are repeated in order to form a thick film, where the inkjet print head (5) performs the ink ejection for ejecting the UV-curing type ink to the print paper (3), and the ultraviolet irradiation device (A) performs the ink curing for curing the ink printed on the print paper (3) immediately following the ink ejection.

14 Claims, 9 Drawing Sheets

| TIME (sec) FROM PRINTING TO CURING | 0 | 1 | 3 | 5 | 7 | 10 | 30 |
|---|---|---|---|---|---|---|---|
| INK FILM THICKNESS ($\mu$m) AFTER 10 TIMES PRINTING | 55 | 22 | 16 | 7 | 4 | 0 | 0 |

| | PRINTING TIMES | 10 | 20 | 30 | 40 | 50 | 60 | 70 |
|---|---|---|---|---|---|---|---|---|
| INK FILM THICKNESS (μm) | IRRADIATION AFTER TEN MINUTES FROM PRINTING | 0 | 37 | 56 | 85 | 119 | 159 | 222 |
| | IRRADIATION IMMEDIATELY AFTER PRINTING (WITHOUT A TIME LAG) | 50 | 102 | 148 | 203 | 229 | 290 | 382 |

INK JET PRINTER AND ITS THICK FILM PRINTING METHOD

TECHNICAL FIELD

The present invention relates to an inkjet printer and a thick film printing method thereof performing thick film printing by ejecting ink through an inkjet print head.

BACKGROUND ART

A thick film printing method of performing thick film printing by inkjet printer has been disclosed. For example, see Japanese laid-open publication number JP-12-37943.

This thick film printing method uses an ink of high viscosity and low wetting property and ejects the ink to a same printing position plural times in order to make a thick film print media. That is, the thick film print media can be formed by laminating the ink ejected on the same position of the print media.

However, the conventional thick film printing method has a drawback that the ink ejection function is wrong because it uses the ink of high viscosity and low wetting property.

Further, even if the conventional method uses the ink of high viscosity and low wetting property, there is a possibility that leveling occurs in the ink that has been laminated at a same position on the print media with the passage of time, and therefore it is extremely difficult to make the thick film printed matter by the conventional method.

Even if the thick film printed matter is obtained, it is difficult to form a detailed, fine, and sharp image of the thick film print media because it cannot be avoided to deform the shape of the thick film caused by leveling.

Furthermore, there is a problem in the conventional thick film printing method that it is necessary to change the kind of the ink suitable for the print media according to the kind of the print media because wetting property, a degree of blur, and other properties are different in the kind of the print media.

Accordingly, an object of the present invention is, with due consideration to the drawbacks of the conventional technique, to provide an inkjet printer and a thick film printing method thereof using an ink of low viscosity suitable for ink ejection performed through an inkjet print head and capable of printing a thick film printed matter of detailed, fine, and sharp image regardless of the kind of the print media.

DISCLOSURE OF INVENTION

In carrying out the invention and according to one aspect thereof, there is provided an inkjet printer for performing printing by ejecting ink to a print media through an inkjet print head comprising ink curing means for immediately curing the ink that has been ejected on the print media. The inkjet printer repeats ink ejection for ejecting the ink onto the print media by the inkjet print head and ink curing for curing the ink ejected on the print media by the ink curing means immediately following this ink ejection. Accordingly, when the ink is ejected on the print media from the inkjet print head, the ink printed on the print media can be cured by the ink curing means immediately following the ink ejection. This can prevent any occurrence of ink permeation into the print media and occurrence of leveling while keeping the shape of the ink ejected on the print media without causing any deformation thereof. The following ink is further ejected repeatedly in order to laminate it on the ink film cured on the print media and in order to form the thick film printed matter.

Further, in the inkjet printer described above, the ink is a photo-curing type ink and the ink curing means is a photo-irradiation device. Accordingly, when the photo-curing type ink is ejected onto the print media through the inkjet print head, the ejected photo-curing type ink is immediately cured by the irradiation of the light from the photo-irradiation device. This can prevent any occurrence of permeation of the ink into the print media and occurrence of leveling while keeping the shape of the ink ejected on the print media without causing any deformation of the ejected shape. The following ink is further ejected in order on the cured ink film in the same manner, so that a thick film printed matter can be formed.

Moreover, in the inkjet printer, the photo-curing type ink is an UV-curing type ink and the photo-irradiation device is an ultraviolet irradiation device. Accordingly, the same action described above can be obtained by irradiating the ultraviolet light onto the target ink position on the print media by the ultraviolet irradiation device per ejection of the UV-curing type ink through the inkjet print head.

Furthermore, in the inkjet printer described above, the ultraviolet irradiation device comprises an ultraviolet light generation section for generating the ultraviolet light, and one or more optical fibers through which the ultraviolet light generated by the ultraviolet light generation section is guided to a position close to the inkjet print head. In the inkjet printer, the ultraviolet irradiation device irradiates the ultraviolet light onto the print media through the tips of the optical fibers. Accordingly, in addition to the action described above, because the beam of the ultraviolet light can be irradiated from a position close to the print media onto the target ink position on the print media, it is possible to provide the ultraviolet light of a sufficiently predetermined-amount by using the ultraviolet irradiation device of a low power.

Moreover, in the inkjet printer as described above, the initiation timing of the operation performed by the ink curing means immediately following the ink ejection is a time before the ink ejected on the print media is permeated in the print media or before leveling. Accordingly, in addition to the action described above, it is possible to certainly cure the ejected ink before permeation of the ink into the print media and before leveling.

Furthermore, in the inkjet printer described above, at least one of the inkjet print head and the print media is controlled so that the inkjet print head and the print media are moved away and approached to each other in order to control in a constant distance between the inkjet print head and a surface of the ink film on the print media. Accordingly, in addition to the action described above, it is possible to eject the ink to a same target position on the print media through the inkjet print head regardless of the thickness of the ink film printed on the print media.

Moreover, in the inkjet printer described above, the print image is divided into plural areas, and the thick film printing including the ink ejection and the ink curing is performed for each divided area. Accordingly, in addition to the action described above, it is possible to control the ink ejection position through the inkjet print head within each area that is smaller in area than the entire image.

Furthermore, in the inkjet printer described above, a three-dimensional image is divided into X-Y plane images per height in Z-axis, and the printing including the ink ejection and the ink curing is performed for each X-Y plane image per height in Z-axis. Accordingly, in addition to the action described above, it is possible to form a three-dimensional image having an uneven form in the tick film printed matter, namely to form a three-dimensional image.

In accordance with another embodiment of the present invention, a thick film printing method of an inkjet printer performs printing by ejecting ink to a print media through an inkjet print head. The method comprises a series of ink ejection process and ink curing process repeatedly. The ink ejection process ejects the ink to the print media through the inkjet print head. The ink curing process cures the ink that has been ejected on the print media immediately following the ink ejection. Accordingly, when the ink is ejected on the print media through the inkjet print head, the ink printed on the print media is cured by the ink curing means immediately following the ink ejection. This can prevent any occurrence of ink permeation into the print media and occurrence of leveling while keeping the shape of the ink ejected on the print media without causing any deformation of the shape of the ink. The following ink is further ejected repeatedly in order to laminate it onto the ink film cured on the print media, so that the thick film printed matter is formed.

Moreover, in the thick film printing method of the inkjet printer described above, the ink is a photo-curing type ink and the ink curing means is a photo-irradiation device. Accordingly, when the photo-curing type ink is ejected onto the print media through the inkjet print head, the ejected ink is immediately cured by the irradiation of the light from the photo-irradiation device. This can prevent any occurrence of ink permeation into the print media and occurrence of leveling while keeping the shape of the ink ejected on the print media without causing any deformation of the shape of the ink. The following ink is further ejected in order onto the cured ink film in the same manner, so that a thick film printed matter is formed.

Moreover, in the thick film printing method of the inkjet printer described above, the photo-curing type ink is an UV-curing type ink and the photo-irradiation device is an ultraviolet irradiation device. Accordingly, the same action described above can be obtained by irradiating the ultraviolet light onto the target ink position on the print media from the ultraviolet irradiation device per ejection of the UV-curing type ink through the inkjet print head.

Further, in the thick film printing method of the inkjet printer described above, the ultraviolet irradiation device comprises an ultraviolet light generation section for generating ultraviolet light, and one or more optical fibers through which the ultraviolet light generated by the ultraviolet light generation section is guided to a position close to the inkjet print head. In the method, the ultraviolet light irradiation device irradiates the ultraviolet light onto the print media through the tips of the optical fibers. Accordingly, in addition to the same effect described above, because the beam of the ultraviolet light can be irradiated from a position close to the print media onto the target ink position on the print media, it is possible to provide the ultraviolet light of a predetermined amount by using the ultraviolet irradiation device of a low power.

Furthermore, in the thick film printing method of the inkjet printer described above, the initiation timing of the operation performed by the ink curing means immediately following the ink ejection is a timing before the ink ejected on the print media is permeated in the print media or before leveling. Accordingly, in addition to the action described above, it is possible to certainly cure the ejected ink before permeation of the ink into the print media and before leveling.

Moreover, in the thick film printing method, at least one of the inkjet print head and the print media is controlled so that the inkjet print head and the print media are moved away and approached to each other in order to control in a constant distance between the inkjet print head and a surface of the ink film on the print media while repeating a series of the ink ejection process and the ink curing process. Accordingly, in addition to the same action described above, it is possible to eject the ink to a same target position on the print media through the inkjet print head regardless of the thickness of the ink film printed on the print media.

Furthermore, in the thick film printing method of the inkjet printer described above, the print image is divided into plural areas, and the thick film printing including the ink ejection and the ink curing is performed for each divided area. Accordingly, in addition to the same action described above, it is possible to control the ejection position of the ink through the inkjet print head within each area that is smaller in area than the entire image.

Moreover, in the thick film printing method of the inkjet printer described above, a three-dimensional image is divided into X-Y plane images per height in Z-axis, and the printing including the ink ejection and the ink curing is performed for each X-Y plane image per height in Z-axis. Accordingly, in addition to the action described above, it is possible to form a three-dimensional image having an uneven form in the tick film printed matter, namely to form a three-dimensional image.

BRIEF DESCRIPTION OF DRAWINGS

FIG. 4A is an ink ejection process in a thick film printing and FIG. 4B is an ink curing process in the thick film printing;

FIG. 6A shows measured data between time and thickness of an ink film from printing to the time to cure the ink, and FIG. 6B shows a graph of those measured data.

FIG. 7B shows a graph of those measured data.

BEST MODE FOR CARRYING OUT THE INVENTION

The best mode for carrying out the invention will now be described in detail with reference to the accompanying drawings.

First Embodiment

Figure 1:
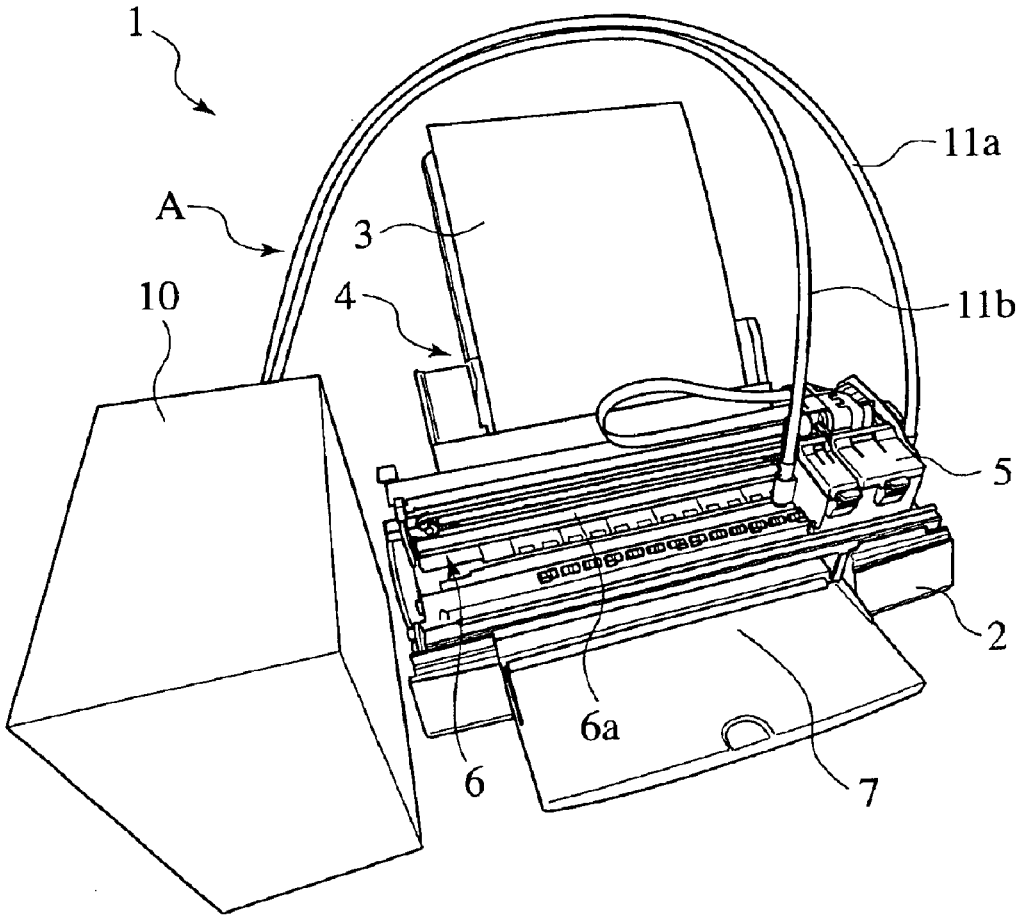
FIG. 1 is a perspective view of an entire configuration of an inkjet printer according to an embodiment of the present invention.
Figure 2:
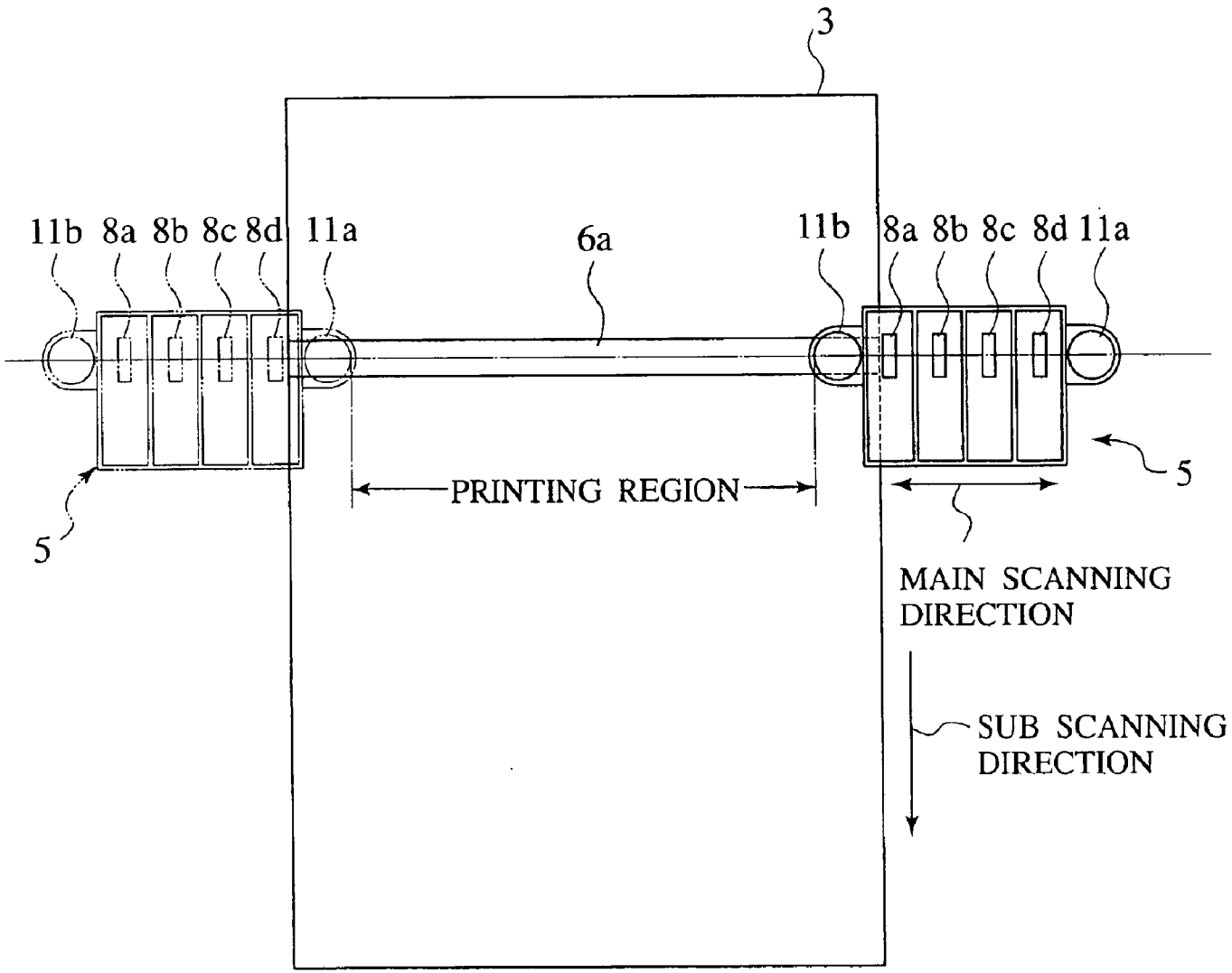
FIG. 2 is a schematic plane view showing a relationship in position between an inkjet print head and the tips of optical fibers according to an embodiment of the present invention.
Figure 3:
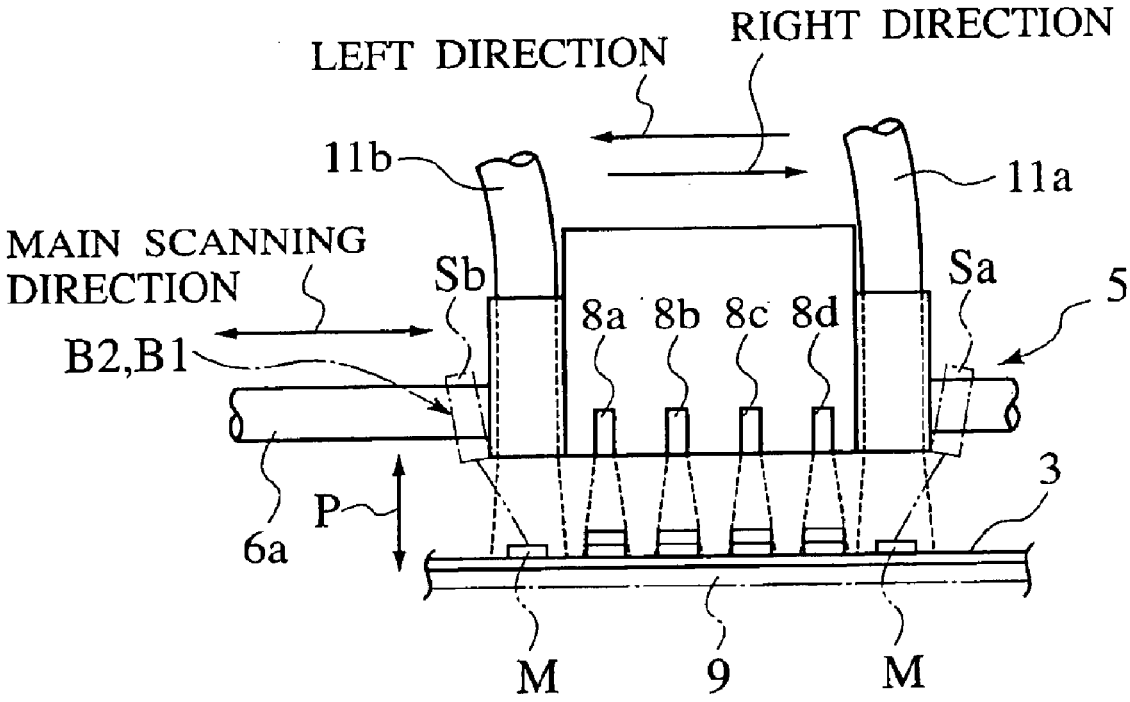
FIG. 3 is a schematic elevation view showing a relationship in position between the inkjet print head and the tips of the optical fibers according to an embodiment of the present invention.
Figure 4A:
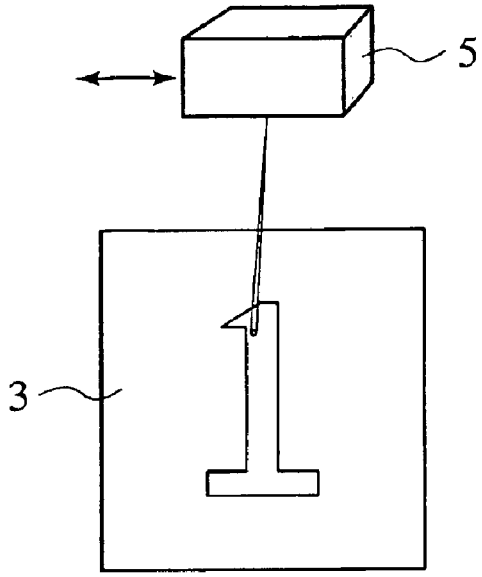
FIGS. 4A and 4B show an embodiment of the present invention, in particularly.
Figure 4B:
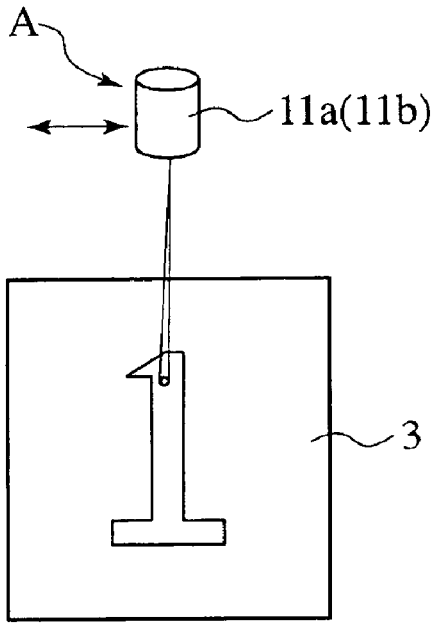
Figure 5A:
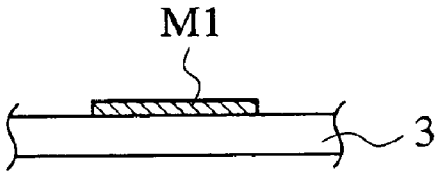
FIGS. 5A to 5C show an embodiment of the present invention, in particularly, each is a sectional view of an ink film on a print paper to explain the thick film printing method.
Figure 5B:
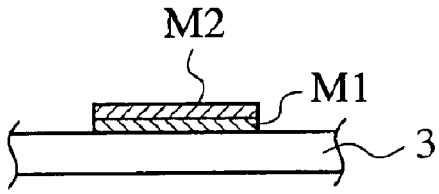
Figure 5C:
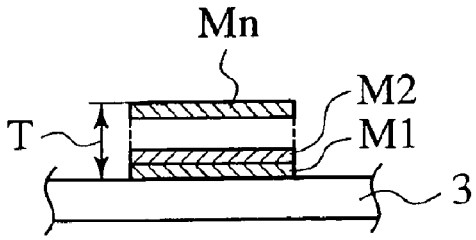

FIG. 1 to FIGS. 5A–5C show an embodiment of the present invention. FIG. 1 is a perspective view of the entire configuration of the inkjet printer 1. FIG. 2 is a schematic plane view showing a relationship in position between the inkjet print head 5 and the tips of optical fibers 11*a* and 11*b*. FIG. 3 is a schematic elevation view showing a relationship in position between the inkjet print head 5 and the tips of the optical fibers 11*a* and 11*b*. FIG. 4A is ink ejection process in thick film printing and FIG. 4B is ink curing process in the thick film printing. FIGS. 5A to 5C show sectional views of the ink film on the print paper 3 to explain the thick film printing method.

In FIG. 1, the inkjet printer 1 comprises a paper feed section 4, a paper carrying means (not shown), the inkjet print head 5, a ultraviolet irradiation device A, a paper ejecting section 7, and ink ejection distance adjusting means B1 or B2. The paper feed section 4 is arranged at the upper section of an inkjet printer body 2 and at which a print paper 3 as a print media is set. The paper carrying means (not shown) carries the print paper 3 that has been set in the paper feed section 4 in a sub scanning direction (which is in the same direction of the carrying direction of the print paper 3) of the inkjet print head 5 with a predetermined speed. The inkjet print head 5 prints the print paper 3 carried by the paper carrying means. The ultraviolet irradiation device A as a photo-irradiation device irradiates ultraviolet light onto a target ink position on the print paper 3 at which UV-curing type ink (photo-curling type ink) has been ejected by the inkjet print head 5. The paper ejecting section 7 ejects the print paper 3 that has been printed by the inkjet print head 5. The ink ejection distance adjusting means B1 and B2 adjust the ink ejection distance from the ink ejection nozzle of the inkjet print head 5 to the target ink position on the print paper 3 so that this distance is kept constant.

The inkjet print head 5 is a serial scanning on-demand type head. This inkjet print head 5 is movable between the position designated by the solid line and the position designated by the two-dot chain lines (as virtual lines) shown in FIG. 2 in a main scanning direction (that is perpendicular to the carrying direction of the print paper 3) along a guide rod 6*a* in a head shifting means 6.

The shifting range of the inkjet print head 5 is so set that the optical fiber 11*b* at the left side of the position designated by the solid line shown in FIG. 2 and the optical fiber 11*a* at the right side in the position designated by the two-dot chain lines shown in FIG. 2 are at least out of the printing area in the print paper 3.

The inkjet print head 5, as shown in FIG. 3, comprises four nozzle head sections 8*a* to 8*d* of an inkjet head type, which are arranged at the positions against the print paper 3 in order to eject four-color UV-curing type inks, yellow, magenta, cyan, and black, corresponding to each of the nozzle head sections 8*a* to 8*d*, respectively. The ejection timing of each of the nozzle head sections 8*a* to 8*d* is controlled based on ejection data.

The UV-curing type ink as a kind of photo-curing type ink is a composite material containing a photo curable prepolymer, a photo curable monomer, and a photo initiator. One or more kinds of photo curable prepolymers and monomers are mixed and one or more kinds of photo initiators are then added to the mixed one, and the UV-curing type ink is manufactured. According to demands, a polymerization inhibitor, a photosensitizer, a colorant, and a surface-active agent are added. It is preferable to use the viscosity of the ink of not more than 20 mPa·S (milli-Pascal·Seconds) for the ink ejection performance.

The ultraviolet irradiation device A as photo-irradiation device, as shown in FIG. 1, comprises an ultraviolet light generation section 10 incorporating an ultraviolet source lamp (not shown) for generating ultraviolet light, and both the optical fibers 11*a* and 11*b* as a duplex optical fiber system, through which the ultraviolet light generated by the ultraviolet light generation section 10 is guided. The tips of both the optical fibers 11*a* and 11*b* as a duplex optical fiber system are fixed at the both sides of the inkjet print head 5 in the main scanning direction.

Because both the optical fibers 11*a* and 11*b* have flexibility, each of the optical fibers 11*a* and 11*b* changes the amount of their flexure according to the shift of the inkjet print head 5 in order to move the tips of them together with the inkjet print head 5 in the main scanning direction.

Next, a description will be given of the relationship between the target ink position on the print paper 3 at which the ink has been ejected from the inkjet print head 5 and the irradiation position of the ultraviolet light through the optical fibers 11*a* and 11*b*.

In FIG. 3, when the inkjet print head 5 is moved from right to left, the optical fiber 11*a* of the right side irradiates the ultraviolet light onto the target ink position immediately following the ejection of the ink. In addition, when the inkjet print head 5 is moved from left to right, the optical fiber 11*b* of the left side irradiates the ultraviolet light onto the target ink position immediately following the ejection of the ink. That is, it is so arranged that the optical fibers 11*a* and 11*b* as a duplex optical fiber system irradiate the ultraviolet light in each of the scanning direction of the inkjet print head 5, respectively.

Next, a description will be given of the thick film printing method by the inkjet printer 1 with reference to FIGS. 4A, 4B and 5A to 5C.

As shown in FIG. 4A, the ink ejection process is performed where the inkjet print head 5 ejects an UV-curing type ink onto the print paper 3 in order to print the print image "1".

Next, immediately following the ink ejection process, as shown in FIG. 4B, through the tips of the optical fibers 11*a* and 11*b* in the ultraviolet irradiation device A, a beam of the ultraviolet light is irradiated onto the target ink position at which the print image "1" has been printed on the print paper 3 in order to perform the ink curing process in which the ink of the printed image "1" is cured. Thereby, as shown in FIG. 5A, the first ink layer M1 is formed.

Next, when the ink ejection process and the ink curing process are performed by the same manner described above, as shown in FIG. 5B, the second ink layer M2 is formed on the first ink layer M1.

The ink ejection process and the ink curing process are repeated desired times in sequential order in order to form the thick film printed matter of a desired thickness T made up of a plurality of ink layers Mn, shown in FIG. 5C.

As will be described later, because it is desirable to cure the ink immediately following the ejection without a time elapse, in actual operation, the beam of the ultraviolet light follows the target ink position on the print paper 3 to which the inkjet print head 5 has ejected the UV-curing type ink, and the irradiation of the ultraviolet light cures the UV-curing type ink in order immediately following the ejection. The above processes are treated as one printing process. The series of the ink ejection process and the irradiation process are repeated desired times in order to perform the overlapping printing process, so that the thick film printed matter can be formed.

In the thick film printing process described above, as soon as the ejection of the UV-curing type ink onto the print paper 3 through the inkjet print head 5, the UV-curing type ink is immediately cured by the irradiation of the ultraviolet light from the ultraviolet irradiation device A. This prevents any permeation of the UV-curing type ink into the print paper 3 after the ink ejection and also avoid any occurrence of the leveling, and the shape of the UV-curing type ink at the ejection time can be kept. Because the ink in the following printing process is laminated on the ink film cured on the print paper 3 in order to form the thick film printed matter, it is possible to form the thick film printed matter of a sharp image regardless of the kind of the print paper 3 even if the ink of low viscosity that is suitable for the ink ejection through the inkjet print head 5 is used.

In addition, because the ultraviolet light is irradiated immediately following the ejection of the ink, it is possible to eliminate any occurrence of permeation of the ink into the print paper 3 even if the UV-curing type ink of low viscosity is used. Furthermore, even if the print paper 3 of easy-to-blur property is used, it can be avoided to blur the ink into the print paper 3. Thereby, the printed matter with which the printed image is not disarranged even if the user touches the printed matter immediately following the printing is obtained.

As described above, the inkjet printer and the thick film printing method of the present invention can easily print signets, stamps, and braille points by the thick film printing. By the way, it is difficult for conventional braille to write braille letters on both surfaces (double sides) of a print paper. On the contrary, the inkjet printer and the thick film printing method of the present invention can easily write braille points on both surfaces of the print paper, and make and provide a book in braille with a thin thickness.

In this embodiment, the ultraviolet light irradiation device A comprises the ultraviolet light generation device 10 for generating the ultraviolet light and the optical fibers 11*a* and 11*b* through which the ultraviolet light is guided to the position close to the inkjet print head 5. Because the beam of the ultraviolet light can be irradiated to the target ink position on the print paper 3, to which the ink has been injected, through both the tips of the optical fibers 11*a* and 11*b* close to the print paper 3. Therefore the ultraviolet irradiation device of a low power can irradiate the ultraviolet light of a sufficiently desired amount. This can provide the ultraviolet irradiation device A of a small size, with low production cost, and a low power.

In the embodiment, the tips of the optical fibers 11*a* and 11*b* are fixed to the inkjet print head 5 and the tips of the optical fibers 11*a* and 11*b* can follow the same printing speed of the inkjet print head 5. Accordingly, it is not necessary to incorporate any fiber shifting means for shifting the tips of the optical fibers 11*a* and 11*b*. This can reduce the number of parts of the inkjet printer and avoid the necessity to control the shifting of the tips of the optical fibers 11*a* and 11*b* and can therefore achieve the ease of control for the inkjet printer.

It is also possible that the tip of the optical fiber (not shown) is arranged independently in configuration from the inkjet print head 5, and the tip of the optical fiber is moved with the motion of the inkjet print head 5 in order to irradiate the ultraviolet light onto the target ink position immediately following the ejection of the UV-curing type ink.

In this embodiment, the dual optical fiber system, namely the optical fibers 11*a* and 11*b*, are mounted and each tip of them is arranged at the both sides of the inkjet print head 5 in the main scanning direction, and the irradiation can be performed through each of the tips of the optical fibers 11*a* and 11*b* in the reciprocating scanning motion of the inkjet print head 5. Therefore it is possible to irradiate the ultraviolet light onto the entire region in the main scanning direction immediately following the ejection of the ink regardless of the scanning direction of the inkjet print head 5. Accordingly, it is possible to cure the UV-curing type ink without any shifting of the irradiation point of the ultraviolet light through the tips of the optical fibers 11*a* and 11*b*.

Moreover, it is possible to incorporate a single optical fiber system including only one optical fiber, or three or more optical fiber systems.

In the thick film printing process described above, when the print image is divided into plural areas and the thick film printing including the ink ejection process and the ink curing process is performed per divided area, it is possible to improve the accuracy of the position of the printed material, because the ink ejection position by the inkjet print head 5 can be detected in each divided area that is smaller than the entire area of the printed image.

Further, it is also possible to firstly print the entire image completely and then perform the printing for each divided area repeatedly in order to perform the thick film printing.

Moreover, when a three-dimensional image is decomposed to X-Y plane image per height in Z-axis, and the X-Y plane images decomposed are printed by repeatedly performing the ink ejection and the ink curing per height in Z-axis, the three-dimensional image having uneven shapes, for example, relief maps and dimensional face picture can be easily printed.

Furthermore, in the thick film printing process described above, it is preferable that the operation initiation timing to irradiate the ultraviolet light by the ultraviolet irradiation device A immediately following the ink ejection is set to the timing before the UV-curing type ink at the target ink position on the print paper 3 is permeated in the print paper 3 or before occurrence of leveling.

When the ultraviolet light is irradiated at this timing, the UV-curing type ink ejected on the target ink position is cured certainly before initiation of the permeation of the UV-curing type ink into the print paper 3 or before occurrence of leveling. This can make thick film printed matters certainly.

Next, a description will be given of the operation initiation timing to irradiate the ultraviolet light with reference to a following concrete experiment in which:

- Optical Modulex SXUID250HUVQ of USHIO Inc. (quartz fiber of 5 mm diameter) was used as the ultraviolet irradiation device A;
- INKJet Printer PM670C of Seiko Epson Corporation was used as the inkjet printer 5;
- Print papers of RISO KAGAKU CORPORATION were used as the print paper 3, and
- Following inks were used as the UV-curing type ink:
  - LIGHT ACRYLATE 1, 9 NDA (KYOEISHA CHEMICAL Co., LTD.) for 63 parts;
  - NK ESTER AMP10G (SHINNAKAMURA CHEMICAL INDUSTRIAL CO., LTD.) for 31 parts;
  - IRGACURE 369 (CIBA SPECIALTY CHEMICALS INC.) for 3 parts; and VALIFAST BLUE2606 (Orient Chemical Industries, Ltd.) for 3 parts.

The thickness (micrometer) of the ink film after overlapped printing of 10 times are measured under various time intervals, 0, 1, 3, 0.5, 7, 10, and 30 seconds, counted from the printing (ink ejection process) to the ink curing (ink curing process) by irradiating the ultraviolet light.

Figures 6A, 6B:
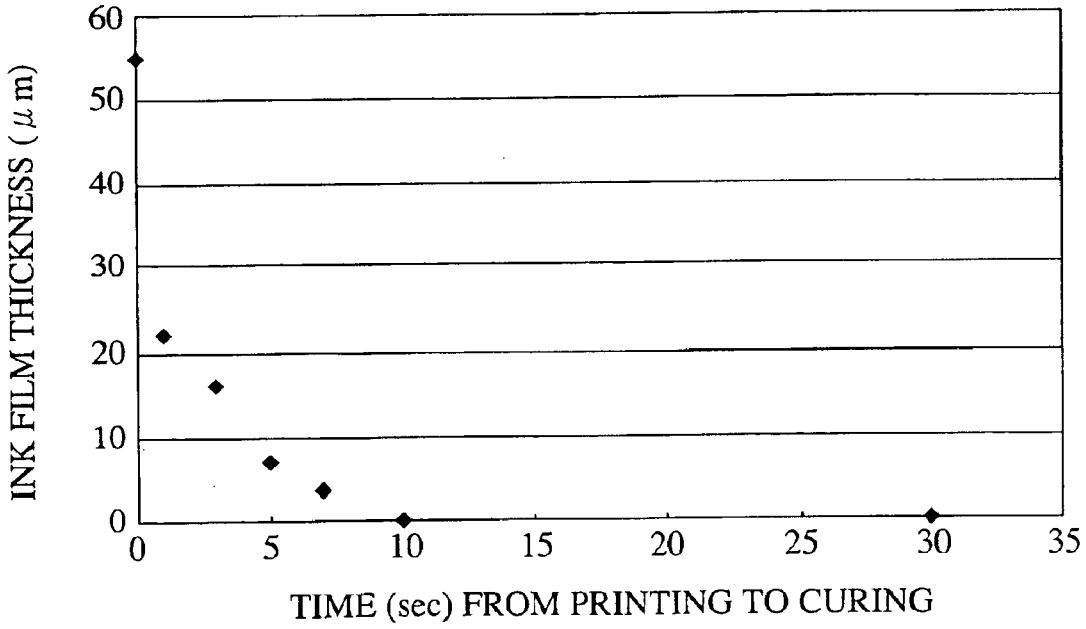
FIGS. 6A and 6B show an embodiment of the present invention, in particularly.

As shown in FIGS. 6A and 6B, in a case where the ink curing process is initiated after ten seconds counted from the printing (ink ejection process), the thickness of the ink film becomes zero because the UV-curing type ink has been permeated into the print paper 3. This case cannot print the thick film even if the overlapped printing process is performed ten times.

Accordingly, it is clear that the ink curing process by irradiating the ultraviolet light must be initiated within less than ten seconds counted from the ink ejection process, and a decreasing of the time interval from the ink ejection to the time of the initiation of the ultraviolet light irradiation increases the thickness of the ink film with low blur. In particularly, it is preferable to irradiate the ultraviolet light without a time elapse (after about zero second) that is the timing at which no blur and no leveling occur.

In a case that the number of the overlapped printing processes is 10, 20, 30, 40, 50, 60, and 70 times, the thickness of the ink film were measured under the conditions that the time interval counted from the printing (ink ejection process) to the ink curing (ink curing process) is 10 seconds and almost zero second.

Figures 7A, 7B:
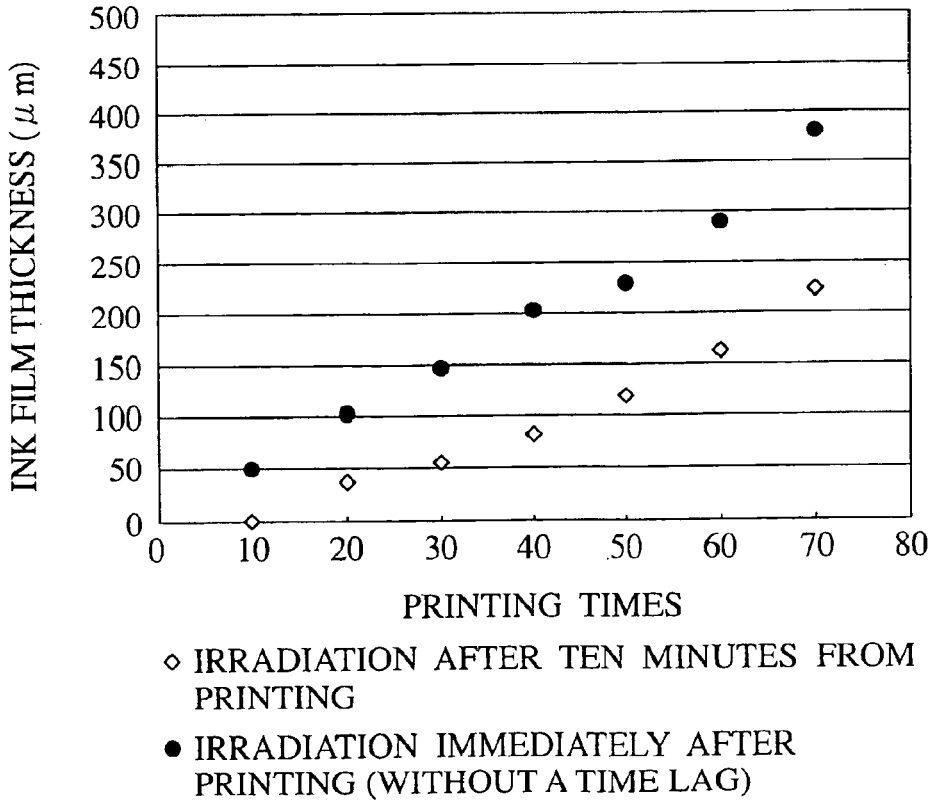
FIGS. 7A and 7B show an embodiment of the present Invention, in particularly, FIG. 7A measured data between the number of printing times and thickness of an ink film in cases where the time period from printing to the time to cure the ink is changed.

As shown in FIGS. 7A and 7B, although a thick film can be obtained under the time interval from each over printing (ink ejection process) to the ink curing (ink curing process) is 10 seconds, a thicker ink film can be formed when the time interval is set to almost zero.

Accordingly, it is experimentally verified that decreasing of the time interval counted from the ink ejection process to the ink curing process can increase the thickness of the ink film without any occurrence of blur and permeation.

In addition, because decreasing of the time interval counted from the ink ejection process to the ink curing process can keep the shape of the ink immediately following the ink ejection, it is possible to form detailed, fine, and clear thick film printed matters.

Next, a description will be given of the case where the inkjet printer 1 of the above embodiment incorporates an ink ejection distance adjustment means B1.

With reference to the configuration shown in FIG. 3, the ink ejection distance adjustment means B1 comprises an adjustment means (not shown), distance sensors Sa and Sb, and a control section (not shown). The adjustment means adjusts at least one of the inkjet print head 5 and a paper setting base 9 on which the print paper 3 is set in a separation direction along which both the print paper 3 and the paper setting base 9 are moved in a direction P through which they are away and approached to each other. The distance sensors Sa and Sb mounted close to each of the optical fibers 11*a* and 11*b* measure the distance to the target ink position on the print paper 3 (the distance to the surface of the print paper 3 when no target ink position is formed on the print paper 3, or the distance to the surface of the ink film M when the target ink position is formed on the print paper 3). The control section controls the operation of the adjustment means based on the results of the measurements so that the distance between the nozzle head sections 8*a* to 8*d* in the inkjet print head 5 and the target ink position becomes a constant distance.

In the thick film printing process by the inkjet printer 1, when the ink is ejected through the inkjet print head 5, the distance sensors Sa and Sb measure the distance to the surface of the ink film M, and the control section controls the adjustment means (not shown) so that the distance between the nozzle head sections 8*a* to 8*d* in the inkjet print head 5 and the target ink position becomes constant based on the results of the measurements by the distance sensors Sa and Sb. The control section controls so that the ink ejection distance becomes a constant distance per ink ejection.

Accordingly, because the distance between the inkjet print head 5 and the target ink position becomes a constant value when the ink is ejected through the inkjet print head 5, the UV-curing type ink can be ejected to the same position regardless of the thickness of the ink film on the print paper 3, so that a detailed, clear, and sharp thick film printed matter can be formed. The present invention is greatly effective in forming very-thick film printed matters.

A description will be given of the case where the inkjet print head 5 incorporates an additional ink ejection distance adjustment means B2 with reference to FIG. 8 and FIG. 9.

Figure 8:
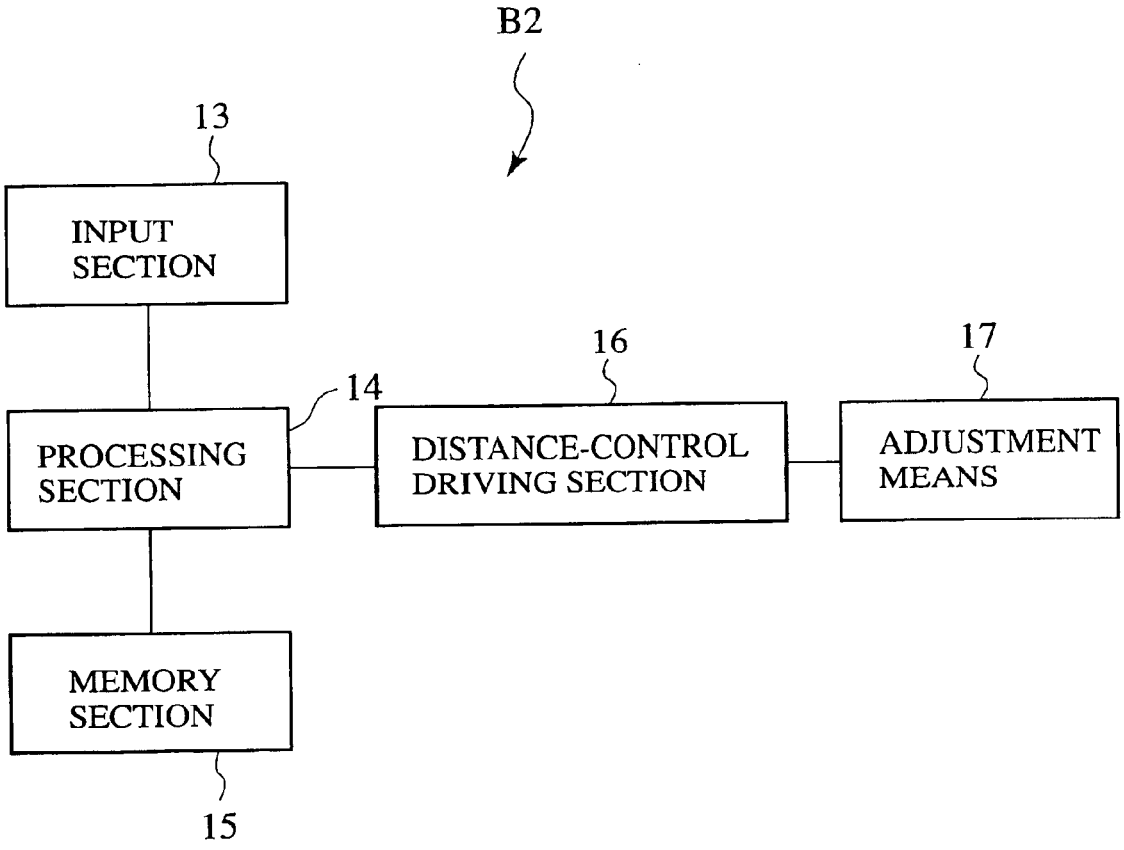
FIG. 8 is a schematic block diagram showing an ink ejection distance adjusting means added to the inkjet printer of an embodiment of the present invention.

FIG. 8 is a schematic block diagram showing this ink ejection distance adjustment means B2. FIG. 9 is a flowchart of the printing operation using the ink ejection distance adjustment means B2.

Figure 9:
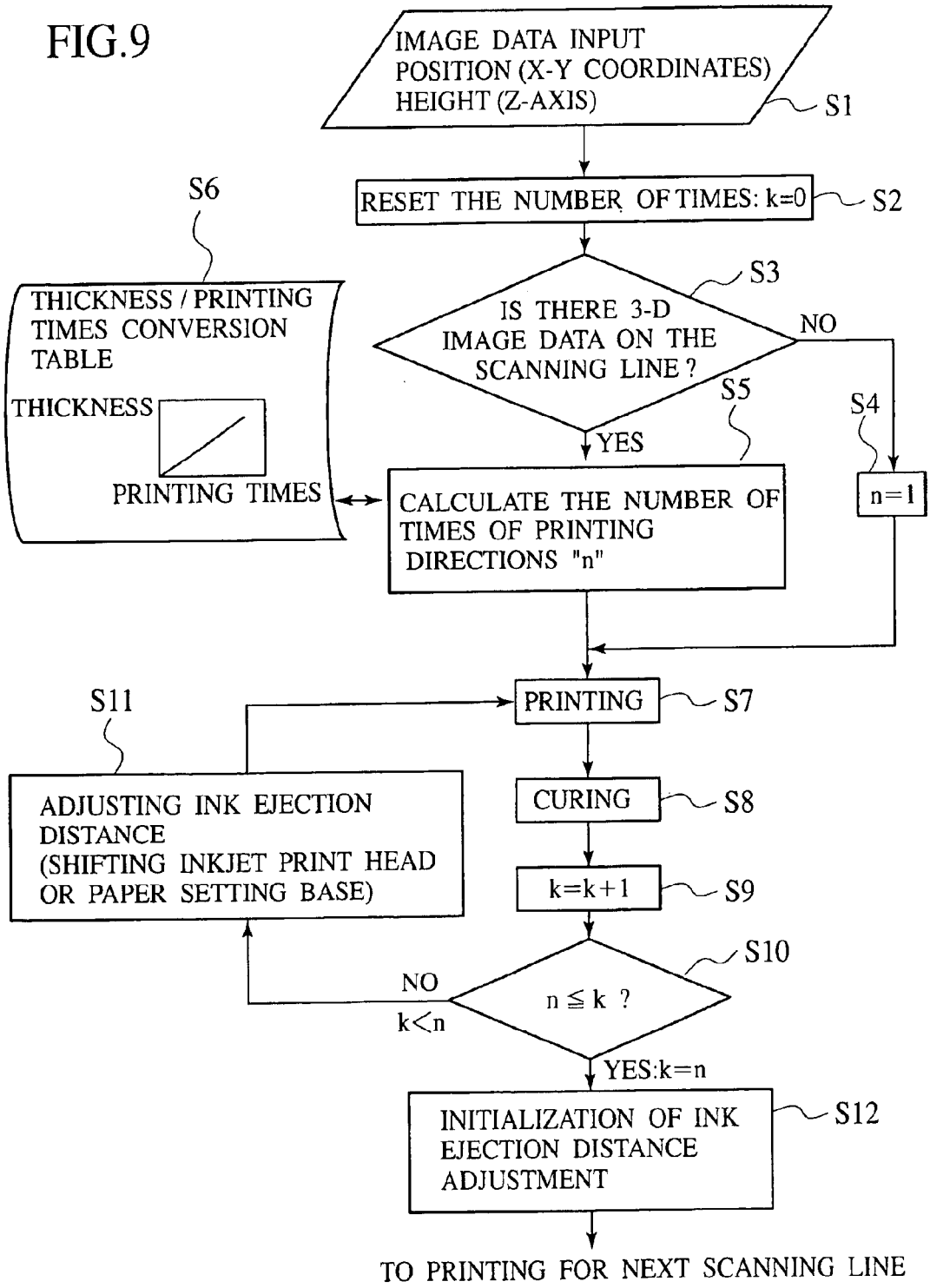
FIG. 9 is a flowchart of the printing operation using the ink ejection distance adjusting means added to the inkjet printer of an embodiment of the present invention.

This ink ejection distance adjustment means B2 comprises, as shown in FIG. 8, an input section 13 for inputting data such as positions and heights of a thick film printed matter, a processing section 14 for performing the operation of the flowchart shown in FIG. 9 according to instructions and data transferred from the input section 13, a memory section 15 for storing programs performing the operation of the flowchart shown in FIG. 9, a distance-control driving section 16 for generating driving signals based on driving control signals transferred from the processing section 14, and an adjustment means 17 that is controlled based on the driving signals from the distance-control driving section 16.

The adjustment means 17 has the same configuration of the ink ejection distance adjustment means B1 and adjusts toward the direction "P", through which the inkjet print head 5 and the paper setting base 9 are moved away and approached to each other, at least one of the inkjet print head 5 and the paper setting base 9 on which the print paper 3 is set.

The operation of the inkjet printer will be explained with reference to FIG. 9.

When the information regarding the position (X-Y coordinates) and the height (Z-axis) of the printed image is inputted through the input section 13 (Step S1), the number of times "k" of printing is set to zero (reset by zero, Step S2). At the same time, it is checked whether or not a 3-D image data is on the scanning line (Step S3). When there is no 3-D image data on the scanning line (namely, thick film printing is not performed), the number of times of printing directions "n" is set to 1 (n=1) (Step S4). Then, the printing operation is performed by the inkjet print head 5 (Step S7) and the ink curing operation is performed by using the ultraviolet light (Step S8). Thereby, the printing operation of scanning line is completed.

Then, the print paper 3 is transferred to the next scanning line in the sub scanning direction, and the initialization for the ink ejection distance is performed (Step S12). That is, the distance between the inkjet print head 5 and the surface of the print paper 3 is set to a predetermined value by controlling the adjustment means 17, and then the next scanning line is performed.

When there is a 3-D image data on the scanning line (this means the thick film printing), the number of times of printing directions is calculated based on inputted data by referring a thickness/printing times conversion table (Step S5). Here, in the thickness/printing times conversion table, the relationship between thickness of the ink film and printing times are stored.

Next, the first printing process (Step S7) and the ink curing process (Step S8) are performed. After this, the printing times "k" is incremented by one (Step S9), and it is checked whether or not the printing times k is not less than the number of times of printing directions "n" (Step S10).

When the printing times "k", the inkjet print head 5 or the paper setting base 9 is adjusted by the distance corresponding to the thickness of the ink film per printing by controlling the adjustment means 17 so that the ink ejection distance from the inkjet print head 5 becomes constant distance (Step S11). After this, the following printing process (Step S7) and the ink curing process (Step S8) are performed again.

Those processes are repeated until the printing number "k" is equal to or more than the number of times of printing directions "n". When "k" is equal to or more than n, the process for this scanning line is completed.

The print paper 3 is then carried to the position of the next scanning line in the sub scanning direction and the initialization for the ink ejection distance, that is, the distance between the inkjet print head 5 and the surface of the print paper 3 is set to the predetermined distance by controlling the adjustment means 17 (Step S12), the printing for the next scanning line is initiated.

That is, the inkjet printer by using the distance sensors Sa and Sb in the former ink ejection distance adjustment means B1 measure the thickness of the ink film in the first printing and the thick film printed matter of a predetermined thickness is formed by repeating a series of the printing process and the ink curing process based on those measured values.

Further, the inkjet printer by using the latter ink ejection distance adjustment means B2 forms the thick film printed matter of a determined thickness by calculating the printing times based on the inputted data by referring the relationship between thickness of the ink film and printing times stored in the memory section 11 that have been measured in advance.

Figure 10:
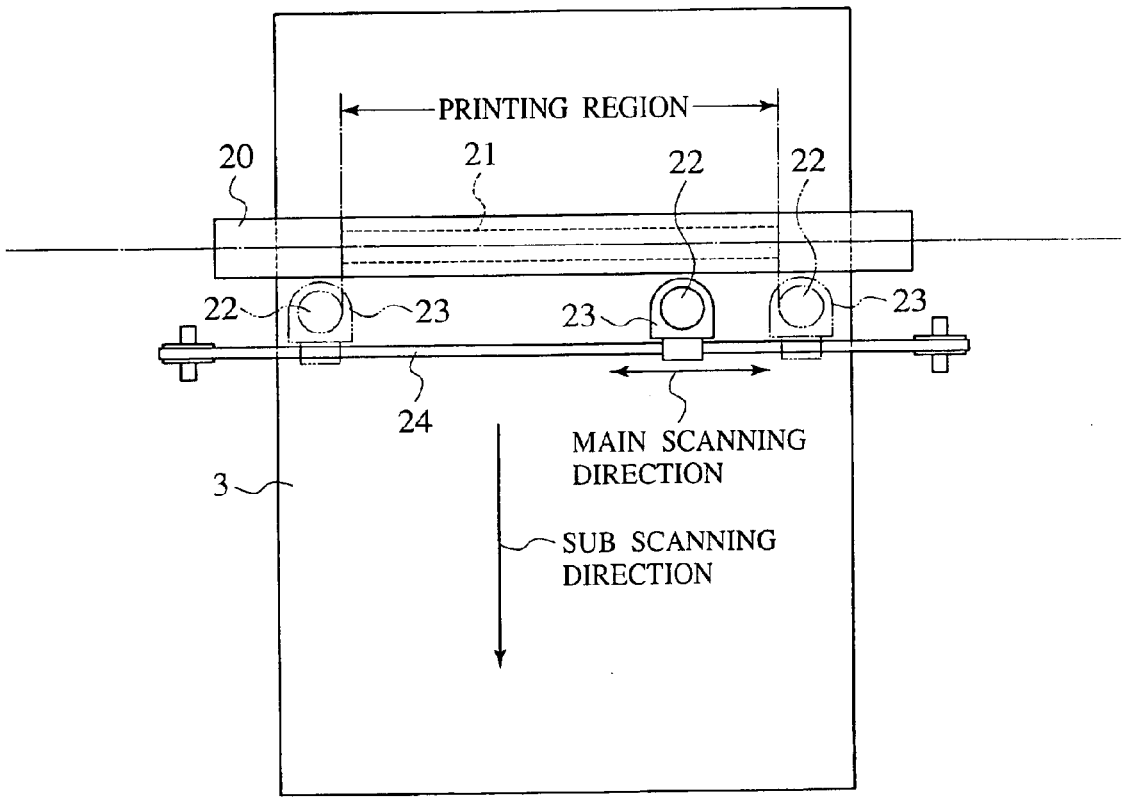
FIG. 10 shows another embodiment of the present invention and is a schematic plan view showing the relationship in position between the inkjet print head and the tip of an optical fiber.

FIG. 10 shows another embodiment of the present invention and is a schematic plan view showing the relationship in position between the inkjet print head 20 and the tip of an optical fiber 22.

In FIG. 10, the inkjet print head 20 in the inkjet printer is a line scanning on-demand type head and fixed, thereby is not shifted in both the main scanning direction and the sub scanning direction. The inkjet print head 20 has a nozzle head section 21 of the length of the print width.

The ultraviolet light irradiation device (not shown) as a photo-irradiation device comprises an ultraviolet light generation section for generating the ultraviolet light and the optical fiber 22 as a single optical system through which the ultraviolet light generated by the ultraviolet light generation section is guided. The tip of the optical fiber 22 is fixed to the fiber movement member 23 arranged in the downstream side of the sub scanning direction of the inkjet print head 20. The fiber movement member 23 is fixed to a movable belt 24. According to the movement of the movable belt 24, the fiber movement member 23 is movable in the main scanning direction.

The moving rang of the optical fiber 22 is set so that it may cover to the outside of the print width of the print paper 3. (The position of the two-dot chain lines shown in FIG. 10.) The optical fiber 22 has a flexibility. The tip of the optical fiber 22 is shifted with the fiber movement member 23 by changing the amount of its flexure according to the movement of the fiber movement member 23.

This inkjet printer of the line scanning on-demand type head can also perform the thick film printing by repeating both the ink ejection process and the ink curing process where the ink ejection process ejects the UV-curing type ink through the inkjet print head 20 to the print paper 3 and the ink curing process cures the ink by irradiating the ultraviolet light to the target ink position on the print paper 3 through the tip of the optical fiber 22 immediately following this ink ejection.

In the thick film printing process, when the UV-curing type ink is ejected to the print paper 3 through the inkjet print head 20, the print paper 3 is carried in the sub scanning direction (the side of the optical fiber 22) in order. The optical fiber 22 also follows the main scanning direction and irradiates the ultraviolet light onto the target ink position at which the ink has been ejected. By the irradiation of the ultraviolet light, the UV-curing type ink is cured in order immediately following the ink ejection.

Because the UV-curing type ink that has been ejected onto the print paper 3 is immediately cured by the irradiation of the ultraviolet light from the ultraviolet irradiation device, this prevents any permeation of the UV-curing type ink into the print paper 3 after the ejection and also avoid any occurrence of leveling and the shape of the UV-curing type ink at the ejection time can be kept. Because the ink in the following printing process is ejected and laminated on the cured ink film on the print paper 3 in order to form the thick film printed matter, like the embodiment previously described, it is possible to form a detailed, fine and clear thick film printed matters regardless of the kind of the print paper 3 even if the ink of low viscosity suitable for the ink ejection through the inkjet print head 20 is used.

In the another embodiment, like the embodiment previously described, when the ink ejection distance adjustment means is added, the UV-curing type ink can be ejected onto a same position regardless of the ink thickness printed on the print paper 3 and the thick film printed matter of a detailed, fine, and sharp image can be printed. Furthermore, the present invention can be effectively applied to printed matters of an extremely thick film.

In the another embodiment described above, although the inkjet print head 20 is fixed in the sub scanning direction, it is possible to have a configuration in which the inkjet print head 20 is carried in the sub scanning direction and the print paper 3 is fixed, not shifted.

Further, each embodiment described above shows that the ink is the UV-curing type ink as a kind of photo-curing type ink, and the ultraviolet irradiation device A is used as the ink curing means which is one kind of the photo-irradiation device. However, it is necessary to have a combination of the ink and the ink curing means capable of curing the ejected ink immediately. For example, it is acceptable to use a combination of a photo-curing type ink other than the UV-curing type ink and other photo-irradiation device (excepting the ultraviolet irradiation device), or also a combination of a heat-curing type ink and a heating device.

In each embodiment described above, although each of the inkjet print heads 5 and 20 ejects the UV-curing type ink one time per pixel, it is possible to eject the UV-curing type ink plural times per pixel.

Further, in the embodiments described above, although the inkjet print head 5 has plural nozzle head sections 8*a* to 8*d* for color print applications, it is possible to apply the present invention to inkjet printers of a single nozzle for mono-color print applications.

As set forth in detail, according to the inkjet printer of the present invention, the inkjet print head performs the ink ejection process of ejecting the ink onto the print media and the ink curing means performs the ink curing process of curing the ink ejected on the print media immediately following the ink ejection, and the ink ejection process and the ink curing process are repeated. Accordingly, when the inkjet print head ejects the ink onto the print media, the ink curing means cures the ink printed on the print media immediately following the ejection of the ink. This can prevent any occurrence of ink permeation into the print media and occurrence of leveling while keeping the shape of the ink ejected on the print media without causing any deformation thereof. The following ink is further ejected and then laminated repeatedly on the ink film cured on the print media in order to form a thick film printed matter. It is therefore possible to form the thick film printed matter of a sharp image regardless of the kinds of the print medias by using the ink of low viscosity suitable for ejection by the inkjet print head.

In addition, according to the thick film printing method of the present invention, when the inkjet print head ejects the ink onto the print media through, the ink curing means cures the ink printed on the print media immediately following the ejection of the ink. This can prevent any occurrence of ink permeation into the print media and occurrence of leveling while keeping the shape of the ink ejected on the print media without causing any deformation thereof. The following ink is further ejected and then laminated onto the ink film cured on the print media repeatedly in order to form a thick film printed matter. It is therefore possible to form a detailed, fine and clear thick film printed matters regardless of the kinds of the print medias by using the ink of low viscosity suitable for the ink ejection through the inkjet print head.

Moreover, according to the inkjet printer and the thick film printing method of the present invention, when the photo-curing type ink is ejected to the print media through the inkjet print head, the ejected ink is immediately cured by the irradiation of the light from the photo-irradiation device. This can thereby prevent any occurrence of permeation of the ink into the print media and occurrence of leveling while keeping the shape of the ejected ink on the print media without causing any deformation of the ejected shape. The following ink is further ejected in order on the cured ink film in the same manner, so that a thick film printed matter can be formed. It is thereby possible to form a thick film printed matter of a detailed, fine, and sharp image regardless of the kinds of print medias by using the ink of low viscosity suitable for the ink ejection.

Moreover, according to the inkjet printer and the thick film printing method of the present invention, the same effect described above can be obtained by irradiating the ultraviolet light onto the target ink position on the print media from the ultraviolet irradiation device per ejection of the UV-curing type ink through the inkjet print head.

Furthermore, in the inkjet printer and the thick film printing method of the present invention, in addition to the effects described above, because the beam of ultraviolet light can be irradiated from a position close to the print media to the target ink position on the print media, it is possible to provide the ultraviolet light of a predetermined amount by using the ultraviolet irradiation device of a low power. It is thereby possible to use the ultraviolet irradiation device of a small size, manufactured by a lower cost, and with a low power.

Moreover, according to the inkjet printer and the thick film printing method of the present invention, in addition to the effects described above, because the ejected ink can be certainly cured before permeation of the ink into the print media and before leveling, it is possible to certainly form the thick film printed matter.

Furthermore, according to the inkjet printer and the thick film printing method of the present invention, in addition to the effect described above, because the ink can be ejected onto a same target position on the print media through the inkjet print head regardless of the thickness of the ink film printed on the print media, the thick film printed matter of a detailed, fine, and sharp image can be formed, and the present invention can be effectively applied to form a very thicker film printed matter.

Moreover, according to the inkjet printer and the thick film printing method described above, in addition to the effects described above, because the ink ejection position through the inkjet print head can be controlled within each area that is smaller in area than the entire image, the present invention contributes to improve the positioning accuracy of the thick film printed matter.

Furthermore, according to the inkjet printer and the thick film printing method of the present invention, in addition to the effects described above, it is possible to form a three-dimensional image having an uneven form in a tick-film printed matter, namely to form a three-dimensional image.

INDUSTRIAL APPLICABILITY

As described above, the inkjet printer and the thick film printing method according to the present invention is capable of printing thick film printed matters of detailed, fine and sharp images by using inks of low viscosity suitable for ink ejection through an inkjet print head regardless of kinds of printed matters.

What is claimed is:

1. An inkjet printer for performing thick film printing by ejecting ink onto a print media, comprising:

an inkjet printhead adapted to repeatedly eject photo-curing type ink onto a selected location of the print media; and an ink curing means comprising a photo-irradiation device that immediately cures the ink that has been ejected on the print media, wherein the inkjet printhead repeats an ejection of ink onto the print media in the selected location to laminate the ink ejected during said repeated ejection to the cured ink and the ink curing means immediately repeats the cure of the ink ejected in the selected location following the repeated ejection.

2. The inkjet printer as claimed in claim 1, wherein the photo-curing type ink is an UV-curing type ink and the photo-irradiation device is an ultraviolet irradiation device.

3. The inkjet printer as claimed in claim 2, wherein the ultraviolet irradiation device comprises: an ultraviolet light generation section for generating ultraviolet light; and one or more optical fibers through which the ultraviolet light generated by the ultraviolet light generation section is guided to a position close to the inkjet print head, wherein the ultraviolet light irradiation device irradiates the ultraviolet light onto the print media through the tips of the optical fibers.

4. The inkjet printer as claimed in claim 1, wherein an initiation timing of the cure operation performed by the ink curing means immediately following the ink ejection is a time before the ink ejected on the print media is permeated in the print media or before leveling.

5. The inkjet printer as claimed in claim 1, wherein at least one of the inkjet print head and the print media is arranged so that the inkjet print head and the print media are moved away and approached to each other in order to control in a constant distance between the inkjet print head and a surface of the ink film on the print media.

6. The inkjet printer as claimed in claim 1, wherein a print image is divided into plural areas, and the thick film printing including the ink ejection and the ink curing is performed for each divided area.

7. The inkjet printer as claimed in claim 1, wherein a three-dimensional image is divided into X-Y plane images per height in Z-axis, and the printing including the ink ejection and the ink curing is performed for each X-Y plane image per height in Z-axis.

8. A thick film printing method of an inkjet printer for performing printing by ejecting ink to a print media through an inkjet print head, comprising the of following steps:

ejecting photo-curing type ink to a selected location on the print media through the inkjet print head;

curing the ink that has been ejected on the selected location immediately following the ink ejection with a photo irradiation device;

repeating the ejection of the ink to the selected location; and repeating the curing to cure the ink ejected during the repeated ejection.

9. The thick film printing method of the inkjet printer as claimed in claim 8, wherein the ink is a photo-curing type ink is an UV-curing type ink and the photo-irradiation device is an ultraviolet irradiation device.

10. The thick film printing method of the inkjet printer as claimed in claim 9, wherein the ultraviolet irradiation device comprises: an ultraviolet light generation section for generating ultraviolet light; and one or more optical fibers through which the ultraviolet light generated by the ultraviolet light generation section is guided to a position close to the inkjet print head, wherein the ultraviolet light irradiation device irradiates the ultraviolet light onto the print media through the tips of the optical fibers.

11. The thick film printing method of the inkjet printer as claimed in claim 8, wherein an initiation timing of the cure operation performed by the ink curing means immediately following the ink ejection is a timing before the ink ejected on the print media is permeated in the print media or before leveling.

12. The thick film printing method as claimed claim 8, wherein at least one of the inkjet print head and the print media is arranged so that the inkjet print head and the print media are moved away and approached to each other in order to control in a constant distance between the inkjet print head and surface of the ink film on the print media while the repeating of the ink ejection process and the ink curing process.

13. The thick film printing method as claimed in claim 8, wherein a print image is divided into plural areas, and the thick film printing including the ink ejection and the ink curing performed for each divided area.

14. The thick film printing method as claimed in claim 8, wherein a three-dimensional image is divided into X-Y plane images per height in Z-axis, and the printing including the ink ejection and the ink curing is performed for each X-Y plane image per height in Z-axis.

* * * * *

UNITED STATES PATENT AND TRADEMARK OFFICE

CERTIFICATE OF CORRECTION

PATENT NO. : 6,846,073 B2
DATED : January 25, 2005
INVENTOR(S) : Yamamoto et al.

It is certified that error appears in the above-identified patent and that said Letters Patent is hereby corrected as shown below:

Column 16,
Line 24, please delete “curing” and replace with -- curing is --

Signed and Sealed this

Twenty-sixth Day of April, 2005

JON W. DUDAS
*Director of the United States Patent and Trademark Office*